US010836562B2

(12) United States Patent
Magness et al.

(10) Patent No.: US 10,836,562 B2
(45) Date of Patent: Nov. 17, 2020

(54) CRYSTALLIZED PLASTIC VALVE FOR AN AEROSOL DISPENSER AND HOUSING THEREFOR

(71) Applicant: The Procter & Gamble Company, Cincinnati, OH (US)

(72) Inventors: Robert Earl Magness, Lebanon, OH (US); David Andrew Dalton, Mason, OH (US); Douglas Bruce Zeik, Liberty Township, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 15/953,699

(22) Filed: Apr. 16, 2018

(65) Prior Publication Data

US 2019/0315559 A1 Oct. 17, 2019

(51) Int. Cl.
*B65D 83/44* (2006.01)

(52) U.S. Cl.
CPC ..... *B65D 83/44* (2013.01)

(58) Field of Classification Search
CPC ..... B65D 83/44; B65D 83/32; B65D 83/38; B65D 83/62; B65D 83/14
USPC ..... 222/402.1, 402.21–402.25
See application file for complete search history.

(56) References Cited

U.S. PATENT DOCUMENTS 2,863,699 A 12/1958 Elser
3,333,743 A 8/1967 Meyers
3,403,804 A 10/1968 Colombo
3,450,254 A 6/1969 Miles
3,647,121 A * 3/1972 Ayres ..... B65D 83/48 222/402.24
RE30,093 E 9/1979 Burger
4,330,066 A 5/1982 Berliner
5,573,043 A * 11/1996 Fuehrer ..... B65B 31/003 141/20
6,019,252 A 2/2000 Benecke et al.
6,039,222 A 3/2000 Smith
6,254,820 B1 7/2001 Cornell
6,557,592 B2 * 5/2003 Nagel ..... F16K 1/306 141/100
7,028,866 B2 4/2006 Kunesh et al.
7,279,207 B2 10/2007 Darr
7,303,087 B2 12/2007 Flashinski et al.
7,769,842 B2 8/2010 Weber
(Continued)

FOREIGN PATENT DOCUMENTS

CA 2988053 A1 * 12/2016
WO WO9108099 A1 6/1991
(Continued)

OTHER PUBLICATIONS

EP Search Report; 19167762.4; dated Oct. 17, 2019; 15 pages.

*Primary Examiner* — Lien M Ngo
(74) *Attorney, Agent, or Firm* — Sarah M DeCristofaro; James E Oehlenschlager

(57) ABSTRACT

A valve for an aerosol dispenser. The valve has a housing as a chassis for other components of the valve. The housing perimetrically joins the valve to an outer container for the aerosol dispenser. The housing has a hole with a moving valve stem to selectively dispense product, upon actuation. The housing, or portions thereof, may be crystallized, to provide strength and dimensional stability, to reduce leakage.

21 Claims, 8 Drawing Sheets

(56) References Cited

U.S. PATENT DOCUMENTS

| | | | | |
|---|---|---|---|---|
| 8,074,847 | B2 | 12/2011 | Smith | |
| 8,096,327 | B2 | 1/2012 | Hirz | |
| 8,505,762 | B2 | 8/2013 | Holbach et al. | |
| 8,511,522 | B2 | 8/2013 | Chan et al. | |
| 8,631,632 | B2 | 1/2014 | Morales et al. | |
| 8,844,765 | B2 | 9/2014 | Tryon | |
| 8,869,842 | B2 | 10/2014 | Smith | |
| 9,061,795 | B2 | 6/2015 | Girardot et al. | |
| 9,132,955 | B2 | 9/2015 | Smith et al. | |
| 9,174,229 | B2 | 11/2015 | Smith | |
| 9,296,550 | B2 | 3/2016 | Smith et al. | |
| 9,334,103 | B2 | 5/2016 | Soliman | |
| 9,573,749 | B2 * | 2/2017 | Jacuk | B65D 83/38 |
| 9,758,294 | B2 | 9/2017 | McDaniel et al. | |
| 9,791,050 | B2 * | 10/2017 | Muzzo | F17C 13/04 |
| 10,029,844 | B2 * | 7/2018 | Seki | B65D 83/38 |
| 10,421,599 | B2 * | 9/2019 | Jacuk | B65D 83/38 |
| 2006/0249543 | A1 | 11/2006 | Pardonge | |
| 2009/0014679 | A1 | 1/2009 | Hygema et al. | |
| 2009/0078903 | A1 | 3/2009 | Rideg | |
| 2011/0248035 | A1 | 10/2011 | Peirsman et al. | |
| 2015/0034682 | A1 * | 2/2015 | Seling | B65D 83/38 222/402.1 |
| 2015/0108387 | A1 * | 4/2015 | Smith | B65D 83/48 251/333 |
| 2015/0197392 | A1 * | 7/2015 | Franz | B65D 83/48 222/402.1 |
| 2015/0375922 | A1 | 12/2015 | Smith | |
| 2016/0368633 | A1 | 12/2016 | Smith et al. | |
| 2016/0368700 | A1 | 12/2016 | Smith | |
| 2016/0376087 | A1 * | 12/2016 | Smith | F16K 1/32 222/402.1 |
| 2018/0043604 | A1 | 2/2018 | Zeik et al. | |
| 2018/0044097 | A1 | 2/2018 | Zeik et al. | |
| 2018/0134481 | A1 | 5/2018 | Bodet | |

FOREIGN PATENT DOCUMENTS

| | | | |
|---|---|---|---|
| WO | 2011042724 | A1 | 4/2011 |
| WO | WO2017021038 | A1 | 2/2017 |
| WO | WO2017021039 | A1 | 2/2017 |
| WO | WO2017215745 | A1 | 12/2017 |
| WO | WO2018213373 | A1 | 11/2018 |

* cited by examiner

CRYSTALLIZED PLASTIC VALVE FOR AN AEROSOL DISPENSER AND HOUSING THEREFOR

FIELD OF THE INVENTION

The present invention relates to crystallized plastic valves for aerosol dispensers.

BACKGROUND OF THE INVENTION

Aerosol dispensers are well known in the art. Aerosol dispensers typically comprise an outer container which acts as a frame for the remaining components and as a pressure vessel for propellant and product contained therein. Outer containers made of metal are well known in the art. However, metal containers can be undesirable due to high cost and limited recyclability. Attempts to use plastic have occurred in the art. Relevant attempts in the art to employ plastic in aerosol dispensers are found in U.S. Pat. Nos. 2,863,699; 3,333,743; 9,296,550; 9,334,103 and 2009/0014679.

The outer containers are typically, but not necessarily, cylindrical. The outer container may comprise a closed end bottom adjoining the sidewalls and for resting on horizontal surfaces such as shelves, countertops, tables etc. The bottom of the outer container may comprise a re-entrant portion as shown in U.S. Pat. No. 3,403,804 or base cup as shown in U.S. Pat. No. 9,061,795. Sidewalls defining the shape of the outer container extend upwardly from the bottom to an open top.

The open top defines a neck for receiving additional components of the aerosol dispenser. The industry has generally settled upon a nominal neck diameter of 2.54 cm, for standardization of components among various manufacturers, although smaller diameters, such as 20 mm, are also used. Various neck shapes are shown in U.S. Pat. Nos. 6,019,252; 7,028,866; 7,279,207 and 7,303,087.

Typically a valve cup is inserted into the neck. The valve cup is sealed against a crimp ring at the top of the neck to prevent the escape of the propellant and loss of pressurization, such as described in U.S. Pat. Nos. 8,074,847; 8,096,327; 8,844,765 and 8,869,842. The valve cup holds the valve components which are movable in relationship to the balance of the aerosol dispenser. Suitable valves are shown in commonly assigned U.S. Pat. Nos. 8,511,522 and 9,132,955. When the valves are opened, product may be dispensed through a nozzle, etc. as described in commonly assigned U.S. Pat. No. 9,174,229.

A valve may be inserted into the valve cup for selective actuation by the user. The valve is typically normally closed, but may be opened to create a flow path for the product to ambient or a target surface. Typical valves have a valve body which acts as a chassis for the other components, a moving valve stem, and seal therebetween. The valve also has attachment features for permanently joining the valve to the outer container.

The valve may be compatible with local recycling standards. Suitable valves are disclosed in commonly assigned U.S. Pat. Nos. 8,511,522 and 9,132,955.

If a valve is to be assembled into an aerosol, typically the valve cup is crimped onto the neck of the aerosol container. But this operation is expensive and is difficult to perform with a plastic valve cup. A separate interlock may be used to attach a valve to a valve cup, particularly a plastic valve and plastic valve cup are used. Suitable interlocks include bayonet fittings and threads as disclosed in commonly assigned P&G application, Case 14458, Ser. No. 15/235,237, filed Aug. 12, 2016. A pressure vessel with a threaded bore is proposed in U.S. Pat. No. 8,505,762.

A bag may be used to contain product for selective dispensing by a user. Dispensing of product from the bag occurs in response to the user actuating the valve. The bag separates product within the bag from propellant disposed between the bag and container. This bag limits or even prevents intermixing of the contents of the bag and the components outside of the bag. Thus, product may be contained in the bag. Propellant may be disposed between the outside of the bag and the inside of the outer container. Upon actuation of the valve, a flow path out of the bag is created. This embodiment is commonly called a bag in can and may be used, for example, in dispensing shaving cream gels. Alternatively, a bag may be directly joined to the valve housing, in a configuration commonly called a bag on valve. A suitable bag configuration is disclosed in commonly assigned application, P&G Case 14458, Ser. No. 15/235,227, filed Aug. 12, 2016 which teaches attaching a bag to a valve cup.

If a bag configuration is desired, propellant may be disposed between the bag and outer container, as disclosed in commonly assigned U.S. Pat. Nos. 8,631,632 and 8,869,842. Afterwards, product fill may occur in a separate, remote, operation, optionally carried out in another location, which may be in the same country or in a different country. Such a manufacturing process can conserve costs in production, shipment and/or storage.

An aerosol container having a bag therein may be made from a dual layer preform, having plural layers disposed one inside the other. Relevant attempts include U.S. Pat. Nos. 3,450,254; 4,330,066; 6,254,820; RE 30093 E; and publications WO 9108099 and US 2011/0248035 A1. But each of these attempts requires a separate operation to attach the bag to the relevant component. Each attachment step takes time in manufacturing and creates the opportunity for leakage if not correctly performed. Improvements in dual layer preforms are found in commonly assigned application P&G Case 14461, application Ser. No. 15/235,279, filed Aug. 12, 2016.

Alternatively, a dip tub may be used if intermixing of the product and propellant is desired. When the user actuates the valve, the product and propellant are dispensed together through the dip tube. One configuration is shown in commonly assigned U.S. Pat. No. 6,039,222. This embodiment may utilize a dip tube. The dip tube takes the product and propellant mixture from the bottom of the outer container. Or a piston may be used to expel product, if it is particularly viscous, as described in commonly assigned US publication 2016/0368633.

Aerosol valves are typically normally closed, and inserted into the neck of the outer container or the valve cup during manufacture. The valve is permanently joined to the outer container, such as by spin welding, threaded fittings or other means.

But if the hole between the seal and the valve stem does not remain round and concentric, leakage of propellant or propellant product mixture past the seal may result. If the valve housing does not conform to prescribed tolerances after being attached to the outer container, leakage therebetween may result. For example, common tolerances for typical aerosols are 0.25 mm and even 0.1 mm. Publication WO 2017021039 and commonly assigned U.S. Pat. No. 9,758,294 teach crystallizing certain components.

Accordingly, this invention addresses the problem of maintaining strength and tolerances in a valve for an aerosol dispenser.

SUMMARY OF THE INVENTION

In one embodiment the invention comprises a valve for use in an aerosol dispenser. The valve has: a housing, the housing having a lower platform for attachment to an outer container of an aerosol dispenser, the platform having a housing hole therethrough, and at least one collar projecting upwardly from the platform, a seal circumscribing the housing hole and having a seal hole therethrough, and a valve stem slidably disposed in the seal hole, wherein at least a portion of the platform is crystallized.

In another embodiment the invention comprises a housing for a valve usable in an aerosol dispenser. The housing has: a lower platform, the platform having a housing hole therethrough, and at least one collar projecting upwardly from the platform, wherein at least a portion of the platform is crystallized.

In another embodiment the invention comprises an aerosol dispenser. The aerosol dispenser has: an outer container having a closed end bottom and a neck with an opening therethrough, a product delivery device disposed in the outer container, a propellant disposed within the outer container at a pressure greater than atmospheric pressure, a normally closed valve sealingly disposed in the neck for selectively dispensing a product from the aerosol dispenser, the normally closed valve comprising a housing having a lower platform, the platform having a housing hole therethrough, wherein at least a portion of the platform is crystallized.

DETAILED DESCRIPTION OF THE INVENTION

Figure 1:
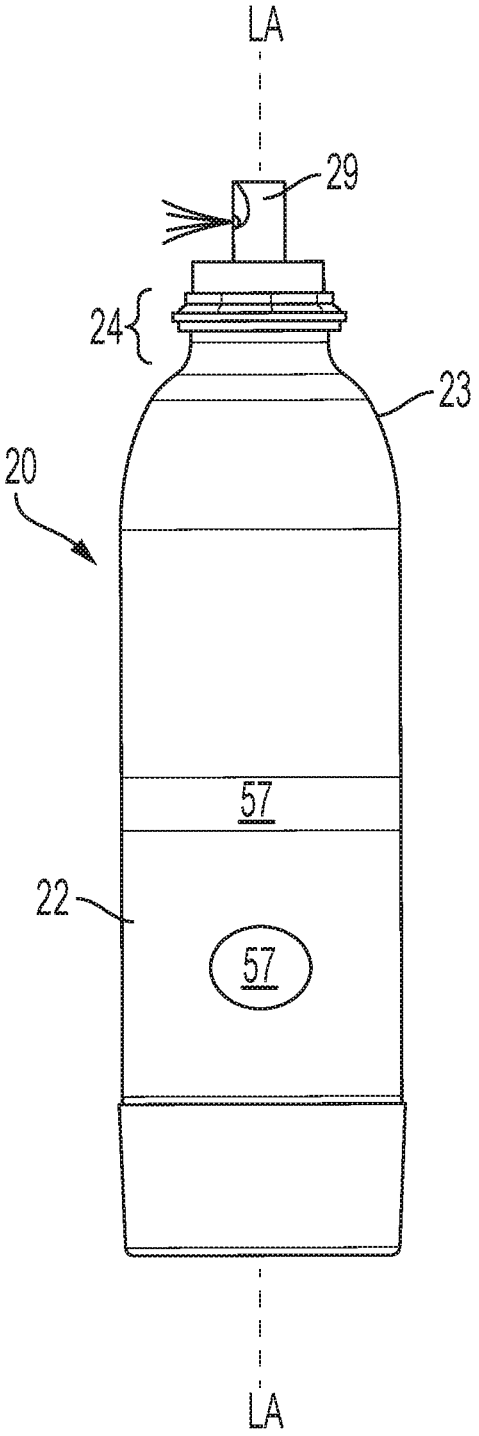
FIG. 1 is a side elevational view of an aerosol dispenser according to the present invention.

Referring to FIG. 1, an aerosol dispenser 20 is shown. The aerosol dispenser 20 comprises a pressurizeable outer container 22 usable for such a dispenser. The outer container 22 may comprise plastic or metal, as are known in the art. The outer container 22 has both product 40 and propellant 42 disposed therein at the point of use.

The outer container 22 has an opening with a valve cup 26 therein. A user activated dispensing valve 28 may be disposed in the valve cup 26. A product delivery device may be joined to the valve cup 26. Propellant 40 may be disposed between the outer container 22 and the product delivery device. The product 42 and propellant 40 may be separately dispensed or may be dispensed together.

The aerosol dispensers 20, and components thereof, may have a longitudinal axis LA, and may optionally be axisymmetric with a round cross section. Alternatively, the outer container 22, a product delivery device therein, a dispensing valve 28, etc., may be eccentric and have a square, elliptical or other cross section.

The outer container 22 may have an opening. The opening is typically at the top of the pressurizeable container 22 when the pressurizeable container 22 is in its-in use position. The opening defines a neck 24, to which other components may be sealed.

The top of the neck 24 may have a crimp ring 24CR thereon. The crimp ring 24CR extends radially outwardly from the neck 24 below. A metal valve cup 26 may be clinched to the crimp ring 24CR in known fashion. A gasket 24G may be disposed between the top of the crimp ring 24CR and the valve cup 26.

The valve cup 26 may be integral and formed from a single piece of metal comprising plural contiguous and annular walls. Alternatively, the valve cup 26 may comprise plastic, or any material suitable for forming around or welding to the crimp ring 24CR. Each wall of the valve cup 26 has opposed inner and outer surfaces, the inner surfaces generally facing downward or towards the longitudinal axis LA.

A dispensing valve 28, in turn, may be disposed within the valve cup 26. The dispensing valve 28 provides for retention of product 42 within the aerosol dispenser 20 until the product 42 is selectively dispensed by a user. The product 42 may be dispensed through a dip tube 56 or from a bag 55, as is known in the art.

The dispensing valve 28 may be selectively actuated by an actuator 29. A suitable subcombination 21 may comprise the outer container 22, valve cup 26, dispensing valve 28, and any propellant 40 therein. The outer container 22, and valve 28 according to the present invention may be entirely polymeric and particularly entirely Stream 1 as defined by the Society of Plastics Engineers.

Selective actuation of the dispensing valve 28 allows the user to dispense a desired quantity of the product 42 on demand. Illustrative and nonlimiting products 42 for use with the present invention may include shave cream, shave foam, body sprays, body washes, perfumes, cleansers, air fresheners, astringents, foods, paints, etc.

Figure 2A:
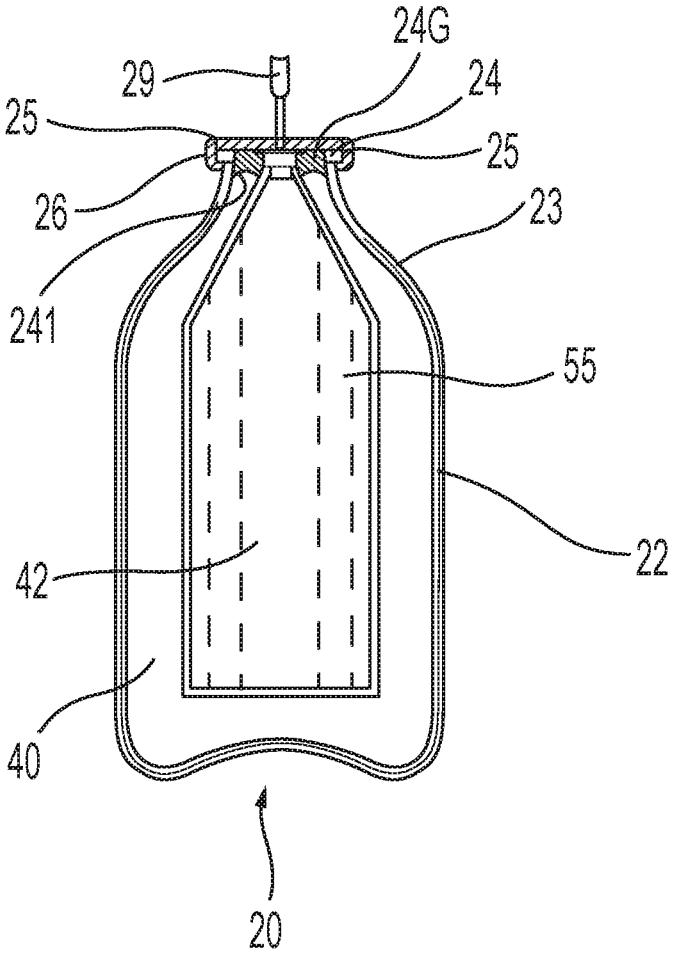
FIG. 2A is a side elevational sectional view of an aerosol dispenser having a collapsible bag.
Figure 2B:
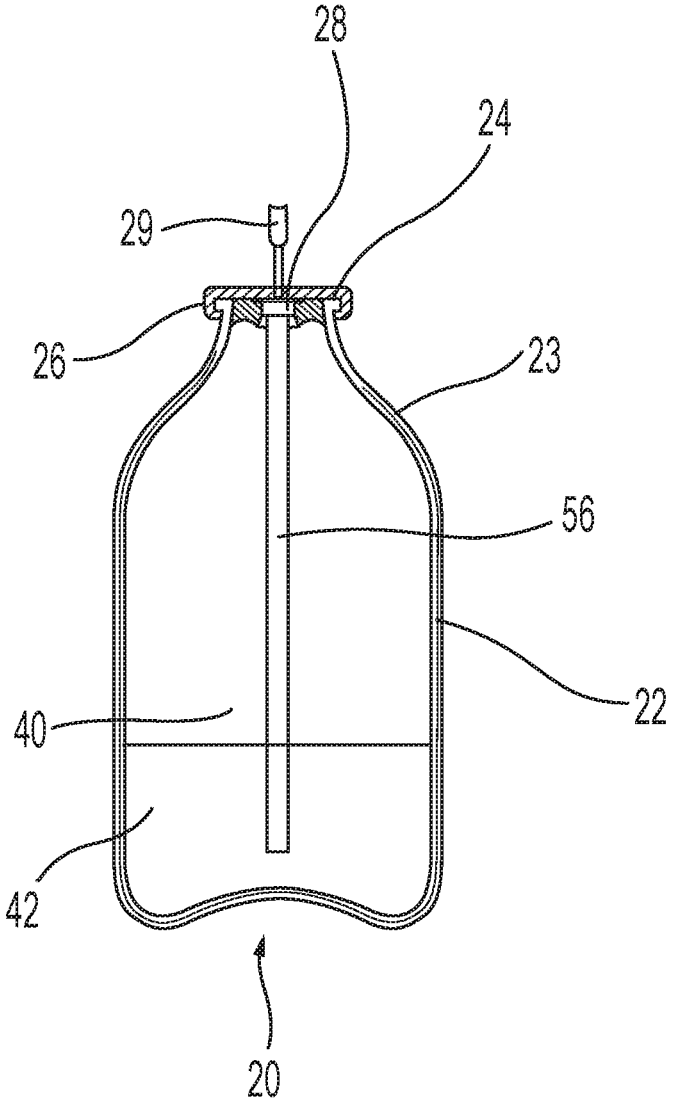
FIG. 2B is a side elevational sectional view an aerosol dispenser having a dip tube.

Referring to FIGS. 2A and 2B, inside the outer container 22 may be a product delivery device. The product delivery device may comprise a collapsible bag 55 as shown in FIG. 2A. The collapsible bag 55 may be mounted in sealing relationship to the neck 24 of the container and/or to the dispensing valve 28. This arrangement is known in the art as a bag-on-valve. The collapsible bag 55 may hold product 42 therein, and prevent intermixing of such product 42 with propellant 40. The propellant 40 may be stored outside the collapsible bag 55, and inside the outer container 22.

The collapsible bag 55 may expand upon being charged with product 42. Such expansion decreases the available volume inside the outer container 22. Decreasing the available volume increases the pressure of any propellant 40 therein according to Boyles law.

The product delivery device may alternatively or additionally comprise a dip tube 56 as shown in FIG. 2B. The dip tube 56 extends from a proximal end sealed to the dispensing valve 28. The dip tube 56 may terminate at a distal end juxtaposed with the bottom of the outer container 22. This embodiment provides for intermixing of the product 42 and propellant 40. Both are co-dispensed in response to selective actuation of the dispensing valve 28 by a user. Again, insertion of product 42 and/or propellant 40 into the outer container 22 increases pressure therein according to Boyles law.

The outer container 22 may comprise a plastic pressurizeable container. The plastic may be polymeric, and particularly comprise PET. The dispensing valve 28, and optional valve cup 26 may be welded to the neck 24 of the outer container 22, as discussed below. The valve cup 26 may be clinched to the neck 24 in known fashion.

Any number of known valve assemblies 28 may be usable with the present invention. One suitable and non-limiting example, is shown. A suitable dispensing valve 28 may be made according to the teachings of commonly assigned publications 2010/0133301A1 and/or 2010/0133295A1, and forms no part of the claimed invention.

The pressurizeable container may further include a propellant 40. The propellant 40 may be disposed between the outer container 22 and the product delivery device. Alternatively propellant 40 may be disposed in the outer container 22 and/or the collapsible bag 55. Typically the pressure in the outer container 22 is greater than the pressure in the collapsible bag 55, so that product 42 may be dispensed from within the bag. If a dip tube 56 is selected for the product delivery device, the propellant 40 and product 42 may be intermixed, and thus co-dispensed. The pressure of the propellant 40 within the outer container 22 provides for dispensing of the product 42/co-dispensing of product 42/propellant 40 to ambient, and optionally to a target surface. The target surface may include a surface to be cleaned or otherwise treated by the product 42, skin, etc. Such dispensing occurs in response to the user actuating the dispensing valve 28.

Examining the components in more detail, the product delivery device may comprise a flexible, collapsible bag 55. The pressure boundary for the propellant 40 is formed, in part, by the collapsible bag 55. Or the product delivery device may comprise a dip tube 56. In either embodiment, the pressure boundary for the propellant 40 is formed, in part by the underside of the dispensing valve 28 when the valve 28 is closed.

If desired, the outer container 22, dispensing valve 28, dip tube 56 and/or collapsible bag 55 may be polymeric. By polymeric it is meant that the component is formed of a material which is plastic, comprises polymers, and/or particularly polyolefin, polyester or nylons. Thus, the entire aerosol dispenser 20 or, specific components thereof, may be free of metal, allowing exposure to microwave energy.

The valve cup 26 may comprise ductile and formable metal such as low carbon steel or aluminum. The valve cup 26 may be stamped and clinched in known fashion.

If desired, the outer container 22, collapsible bag 55, and/or dip tube 56, may be transparent or substantially transparent. If both the outer container 22 and a collapsible bag 55 used as the product delivery device are transparent, this arrangement provides the benefit that the consumer knows when product 42 is nearing depletion and allows improved communication of product 42 attributes, such as color, viscosity, etc. Also, labeling or other decoration 57 of the container 22 may be more apparent if the background to which such decoration is applied is clear. Alternatively or additionally, the outer container 22, collapsible bag 55, etc. may be transparent and colored with like or different colors.

The outer container 22 may define a longitudinal axis LA of the aerosol dispenser 20. The outer container 22 may be axisymmetric as shown, or, may be eccentric. While a round cross-section is shown, the invention is not so limited. The cross-section may be square, elliptical, irregular, etc. Furthermore, the cross section may be generally constant as shown, or may be variable. If a variable cross-section is selected, the outer container 22 may be barrel shaped, hourglass shaped, or monotonically tapered.

The outer container 22 may range from 6 to 40 cm in height, taken in the axial direction and from 4 to 60 cm in diameter if a round footprint is selected. The outer container 22 may have a volume ranging from 50 or 115 cc to 1000 cc exclusive of any components therein, such as a product delivery device. The outer container 22 may be injection stretch blow molded. If so, the injection stretch blow molding process may provide a stretch ratio of greater than 8, 8.5, 9, 9.5, 10, 12, 15 or 20.

The outer container 22 may sit on a base. The base is disposed on the bottom of the outer container 22 and of the aerosol dispenser 20. Suitable bases include petaloid bases, champagne bases, hemispherical or other convex bases used in conjunction with a base cup. Or the outer container 22 may have a flat base with an optional punt.

A punt is a concavity in the bottom of the container and extending towards the neck 24 of the container. A punt is distinguishable from a general concavity in the bottom of a container, as a punt has a smaller diameter than is defined by the footprint of the bottom of the container. The punt may be axisymmetric about the longitudinal axis LA. The vertex of the punt may be coincident the longitudinal axis LA. The outer container 22 sidewall also defines a diameter.

The plastic outer container 22 preferably does not creep under pressures ranging from 100 to 970 kPa, and having a sidewall thickness less than 0.5 mm. The outer container 22 may be pressurized to an internal gage pressure of 100 to 970, 110 to 490 or 270 to 420 kPa. A particular aerosol dispenser 20 may have an initial propellant 40 pressure of 1100 kPA and a final propellant 40 pressure of 120 kPa, an initial propellant 40 pressure of 900 kPA and a final propellant 40 pressure of 300 kPa, an initial propellant 40 pressure of 500 kPA and a final propellant 40 pressure of 0 kPa, etc. The propellant 40 pressurizes the product 42 to a pressure greater than ambient, to provide for delivery from the aerosol dispenser 20.

The aerosol dispenser 20, as presented to a user may have an initial pressure. The initial pressure is the highest pressure encountered for a particular filling operation, and corresponds to no product 42 yet being dispensed from the product delivery device. As product 42 is depleted, the outer container 22 approaches a final pressure. The final pressure corresponds to depletion of substantially all product 42, except for small residual, from the product delivery device.

The outer container 22, and all other components, except the TPE gasket 24G, and valve cup 26 may comprise, consist essentially of or consist of PET, PEN, Nylon EVOH or blends thereof to meet DOT SP 14223. Such materials may be selected from a single class of recyclable materials, as set forth above by the SPI.

The neck 24 may be connected to the container sidewall by a shoulder 23. The shoulder 23 may more particularly be joined to the sidewall by a radius. The shoulder 23 may have an annular flat. The neck 24 may have a greater thickness at the top of the outer container 22 than at lower portions of the neck 24 to provide a differential thickness. Such differential thickness may be accomplished through having an internally stepped neck 24 thickness.

The product 42 may also be inflammable. Flammability, and the absence thereof, may be determined in accordance with the absence of a fire point per ASTM D 92, Standard Test Method for Flash and Fire Points by Cleveland Open Cup Tester, by ASTM E-681 and/or EU A11 test methods.

The propellant 40 may comprise nitrogen, air hydrofluoroolefin and mixtures thereof. Propellant 40 listed in the US Federal Register 49 CFR 173.115, Class 2, Division 2.2 are also considered acceptable. The propellant 40 may particularly comprise a hydrofluoroolefin, a Trans-1,3,3,3-tetrafluoroprop-1-ene, 1-chloro-3,3,3-trifluoroprop-1-ene, (1E), and optionally a CAS number 1645-83-6 gas. Suitable propellants 40 are commercially available from Honeywell International of Morristown, N.J. under the trade names SOLSTICE® ZE (HFO-1234ze) and SOLSTICE® PF (HFO-1233zd(E)).

If desired, the propellant 40 may be condensable. By condensable, it is meant that the propellant 40 transforms from a gaseous state of matter to a liquid state of matter within the outer container 22 and under the pressures encountered in use. Generally, the highest pressure occurs after the aerosol dispenser 20 is charged with product 42 but before that first dispensing of that product 42 by the user. A condensable propellant 40 provides the benefit of a flatter depressurization curve as product 42 is depleted during usage.

A condensable propellant 40 provides the benefit that a greater volume of gas may be placed into the container at a given pressure. Upon dispensing of a sufficient volume of product 42 from the space between the outer container 22 and the product delivery device, the condensable propellant 40 may flash back to a gaseous state of matter.

The pressurizeable container 22 may be charged with an amount of product 42 which brings the pressure, as initially presented to the user, sufficient to dispense and substantially deplete the product 42 from the aerosol dispenser 20. The final pressure, after substantially all product 42 is depleted, is less than the initial pressure.

Product 42 may be charged into the container through the dispensing valve 28, as is known in the art. When product 42 is charged into the container, the product 42 increases the pressure of the propellant 40. The increase in propellant 40 pressure occurs due to the increase in volume of the collapsible bag 55 if such a bag 55 is used as a product delivery device. Likewise, the increase in propellant 40 pressure occurs due to the increase in the number of moles of product 42 in the outer container 22 if a dip tube 56 is selected. An aerosol dispenser 20 may be made according to commonly assigned US 2012/0292338A1; US 2012/0291911A1; and/or US 2012/0291912A1.

The pressure of the propellant 40 at the end of the first phase of manufacture may correspond to the pressure at the end of the usable life of the aerosol dispenser 20, herein referred to as the final pressure. The pressure of the propellant 40 at the end of the second phase of manufacture may correspond to the pressure as initially presented to the user.

The propellant 40 may be provided at a pressure corresponding to the final pressure of the aerosol dispenser 20 when substantially all product 42 is depleted therefrom. The propellant 40 may be charged to a pressure of less than or equal to 300, 250, 225, 210, 200, 175 or 150 kPa. The propellant 40 may be charged to a pressure greater than or equal to 50, 75, 100 or 125 kPa. The gage pressures cited herein are to be construed as the initial pressure inside the outer container 22, as manufactured and prior to first use.

Plural valves 28 may be used with a single outer container 22. This arrangement provides the benefit that product 42 and propellant 40, or disparate products 42, are mixed at the point of use, allowing synergistic results between incompatible materials. This arrangement also provides the benefit that delivery of the propellant 40 provides motive force to the product 42, often resulting in smaller particle size distributions. Smaller particle size distributions can be advantageous for uniform product 42 distribution and minimizing undue wetting.

The aerosol dispenser 20, and particularly the outer container 22 thereof, may have a burst pressure of at least 1100 kPa at 54.4 degrees C. and further may have a burst pressure of at least 1650 kPa at 20 degrees C. Meeting these burst pressures is believed to avoid the need for using DOT exemptions.

Figure 3:
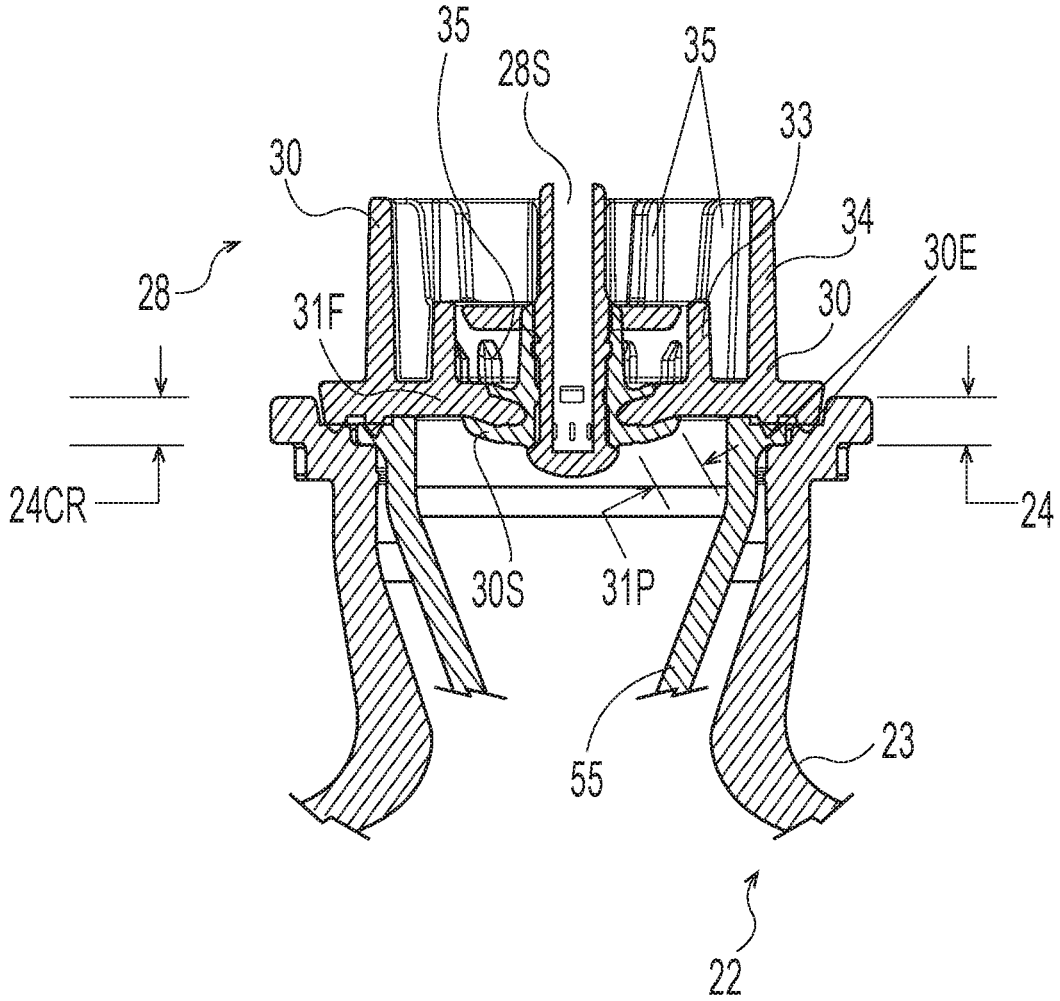
FIG. 3 is a fragmentary vertical sectional view of a valve disposed on an outer container and having a bag.
Figure 4A:
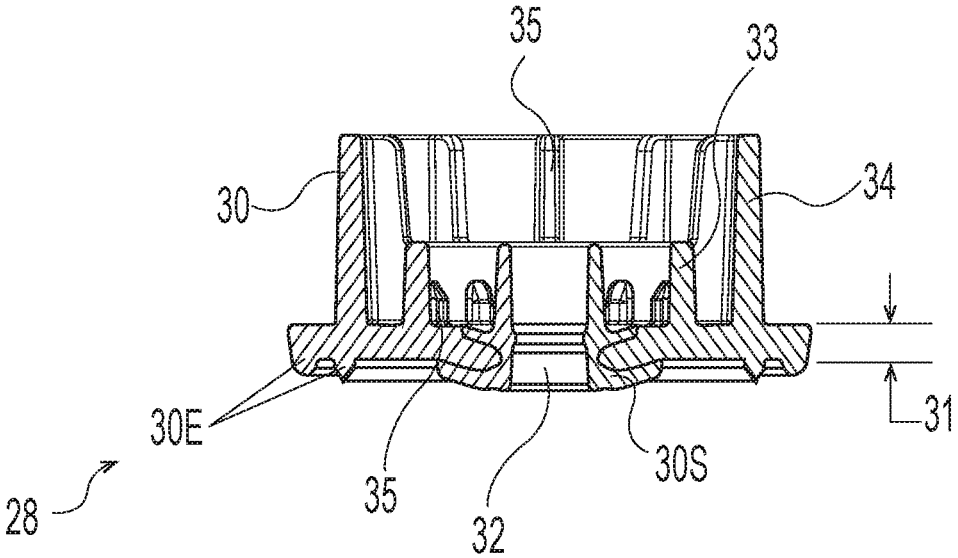
FIG. 4A is a vertical sectional view of the valve body and seal shown in FIG. 3.
Figure 4B:
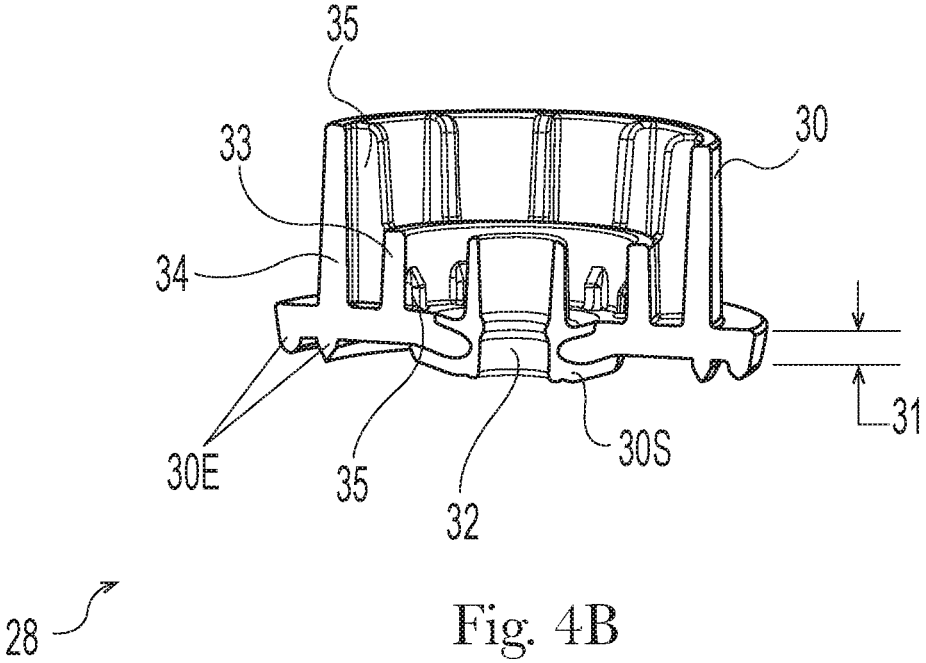
FIG. 4B is a perspective vertical sectional view of the valve body and seal shown in FIG. 3.
Figure 5A:
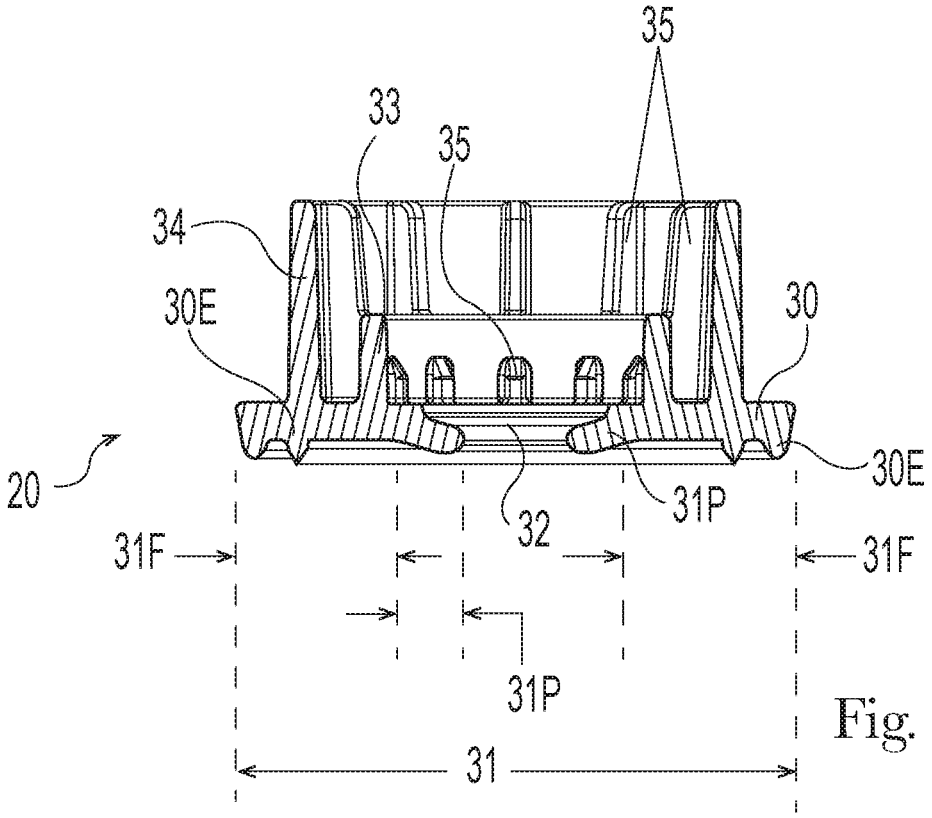
FIG. 5A is a vertical sectional view of the valve body shown in FIG. 4A having the seal omitted for clarity.
Figure 5B:
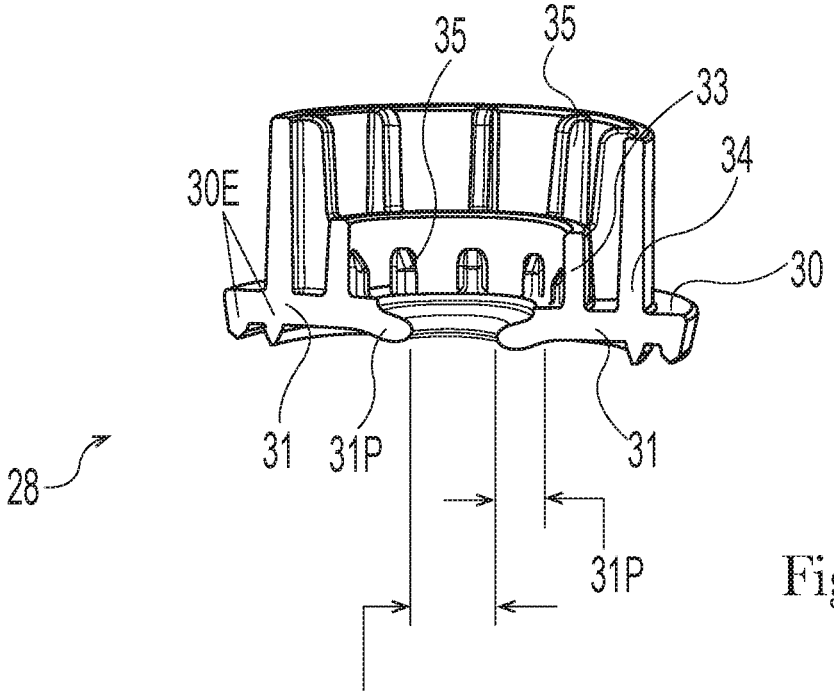
FIG. 5B is a perspective vertical sectional view of the valve body shown in FIG. 4B having the seal omitted for clarity.

Referring to FIG. 3, it is not necessary that the aerosol dispenser 20 have a valve cup 26. In any case, the valve 28 may be attached to the outer container 22, using spin welding, as is known in the art. Alternatively, the valve 28 may be attached to the outer container 22, using a threaded connection as disclosed in commonly assigned publication 17199217.5, filed Oct. 30, 2017, other welding techniques, adhesive etc. The housing 30 typically holds a concentric seal 30S, which has a hole 32 therethrough to provide the interface between the valve stem 28S which moves relative to the outer container 22 and the housing 30 which is stationary relative to the outer container 22.

The seal 30S may comprise TPE, as disclosed above. The TPE material may also function as an integral spring, biasing the valve stem 28S to a normally closed position. Alternatively, a separate spring may be used. The seal 30S has a seal hole therethrough disposed within and preferably concentric to the housing hole 32. The valve stem 28S may comprise two or more pieces assembled together, after the seal 30S is inserted into the housing hole 32 in the housing 30, as disclosed in commonly assigned application Ser. No. 15/912,643 filed Mar. 6, 2018.

Referring to FIGS. 4A-5B, and examining the housing 30 in more detail, the housing 30 may comprise, consist essentially of or consist of PET, may comprise a PET/PEN blend, or other materials. The housing 30 has a lower platform 31 which forms the pressure boundary with the propellant 40 and provides for attachment to the outer container 22. The platform 31 may have one or more optional energy concentrators 30E, to provide for advantageous attachment during spin welding.

A housing hole 32 is disposed, preferably concentrically, through the lower platform 31 to accommodate the moving valve stem 28S. The hole 32 is typically round, having a diameter of 4 to 10 mm, although other shapes of holes 32 are feasible and contemplated. Distortion of the hole 32 through the housing 30 has been found by the inventors to lead to leakage.

The platform 31 may have an annular pocket 31P circumscribing the hole 32 and sloped downwardly towards the hole 32. The pocket 31P provides the function of resisting upward stresses and may have an outer diameter of 2 to 4 mm. A horizontal flange 31F is disposed outboard of and circumscribes the pocket 31P, to bridge the radial distance to the outer container 22.

An optional inner collar 33 projects upwardly from the platform 31. The inner collar 33 provides the function of mating with the actuator 29, provides a stop for valve stem 28S travel and centers the valve stem 28S. An outer collar 34 projects upwardly from the platform 31 and is disposed outboard of the inner collar 33. The outer collar 34 provides the function of protecting the valve stem 28S during manufacture. The inner collar 33 and outer collar 34 may be of equal height relative to the top of the platform 31 or either may be taller than the other. Either or both of the inner collar 33 and outer collar 34 may circumscribe the hole 32, or may be deployed as a series of upstanding pickets, as disclosed in commonly assigned application Ser. No. 15/606,894 filed May 26, 2017 with FIGS. 6A1, 6A2, 8A, 8B, 10 and 11 thereof particularly incorporated herein by reference.

Either or both of the inner collar 33 and/or outer collar 34 may have optional reinforcing ribs 35 internal or external thereto. The ribs 35 provide structural support for the inner collar 33 and/or outer collar 34. The ribs 35 also provide a chuck for performing the spin welding operation.

Crystallizing may be performed by heating the housing 30 while it is in the injection mold, as is known in the art. Alternatively or additionally, the housing may be heated above the Tg in an oven or by induction heating after the housing 30 has been cooled. A PET housing 30 may be crystalized to at least 20%, 30%, or up to 40%, as measured by a DSC, as disclosed in commonly assigned U.S. Pat. No. 9,758,294, the test method being particularly incorporated herein by reference. Crystallization to less than 20% is considered amorphous for purposes herein. A housing 30 made of other material may be crystallized to an appropriate degree to functionally provide the strength and dimensional stability disclosed herein.

According to the present invention, the entire housing 30 may be crystallized. This arrangement provides the benefit that precise control need not be confined to any particular portion of the housing 30 and the housing may be crystallized in the mold. Alternatively, only the platform 31 may be crystallized. This arrangement provides the benefit of conserving energy relative to crystallizing the entire housing 30, while providing stability for the pressure boundary and dimensional control for attachment to the outer container 22. Alternatively, only the pocket 31P may be crystallized. This arrangement provides the benefit of further conserving energy while providing dimension control for the hole 32, minimizing leakage between the seal 30S and valve stem 28S. Generally, the inventors believe there is no benefit to crystallizing only the inner collar 33 or outer collar 34.

Figure 6:
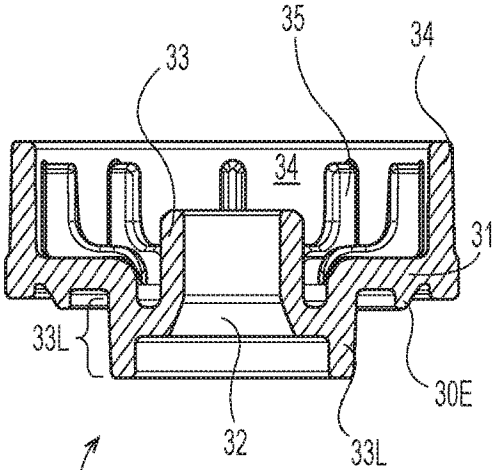
FIG. 6 is a vertical sectional view of an alternative embodiment of a valve body.

Referring to FIG. 6, if desired the platform 31 may have a lower collar 33L. In contrast to inner collar 33 and outer collar 34 which extend upwardly from the platform 31, the lower collar 33L may be distended downwardly from the platform 31. This arrangement advantageously provides section modulus below the platform 31. Further, it is not necessary that the inner collar 33 and outer collar 34 be coextensive in the longitudinal direction. Again, any desired portion of the lower platform 31 may be crystallized as desired.

Figure 7A:
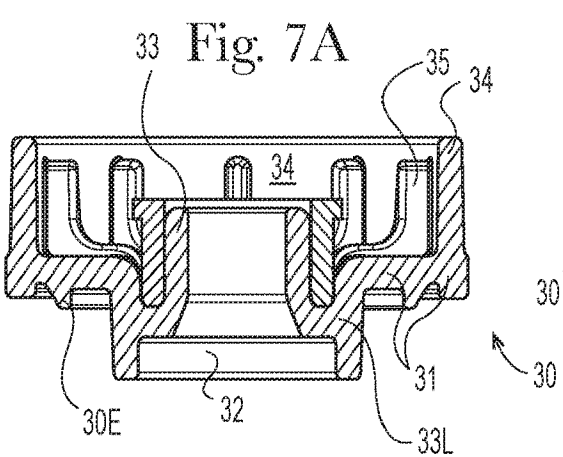
FIG. 7A is a vertical sectional view of an alternative embodiment of a valve body having a reinforcing sleeve.
Figure 7C:
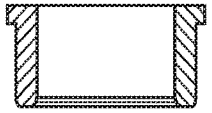
FIG. 7C is a vertical sectional view the sleeve, taken through lines 7C-7C of FIG. 7B.
Figure 7B:
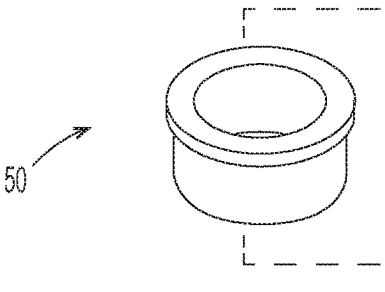
FIG. 7B is a perspective view of the reinforcing sleeve of FIG. 7A.

Referring to FIGS. 7A-7C, a housing 30, such as the housing of FIG. 6, may be reinforced with a reinforcing sleeve 50. The reinforcing sleeve 50 may be inserted onto the housing 30 from above, i.e. in the longitudinally downward direction.

The sleeve 50 may comprise a polymeric material, such as PET, compatible with or identical to the material selected for the housing 30. The sleeve 50 may be crystallized to provide reinforcement to the housing 30. If desired, the sleeve 50 may be metal or carbon fiber reinforced for hoop strength. If a carbon fiber sleeve 50 is selected, the heterogenous carbon fibers are preferentially circumferentially oriented for hoop strength, although biased orientations are contemplated and feasible. If so, the housing 30 prophetically need not be crystallized, although crystallization of both the housing 30 and sleeve 50 are feasible and contemplated herein.

The sleeve 50 may simply be inserted and rested into place on the housing 30, may be welded, particularly spin welded to the housing 30, may be friction fitted to the housing 30 and/or may be adhesively joined to the housing 30. Particularly, the sleeve 30 may be used to radially reinforce the inner collar 33 and ultimately the hole 32. This arrangement provides the benefit that selective crystallization of the housing 30 may or may not occur.

Figure 8A:
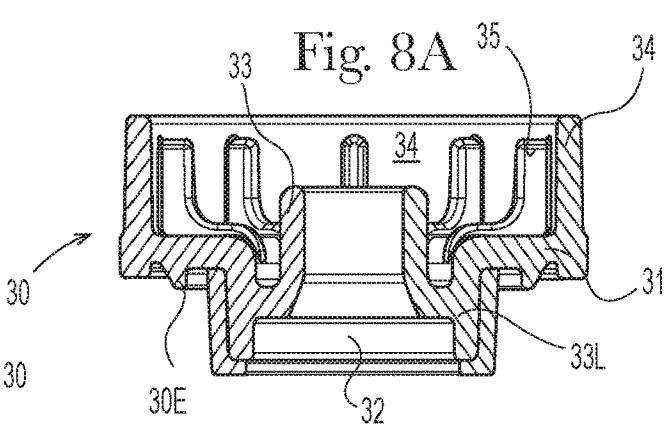
FIG. 8A is a vertical sectional view of an alternative embodiment of a valve body having a reinforcing sleeve.
Figure 8C:
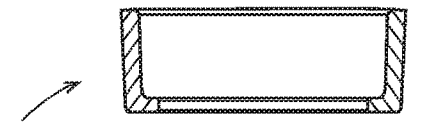
FIG. 8C is a vertical sectional view the sleeve, taken through lines 8C-8C of FIG. 8B.
Figure 8B:
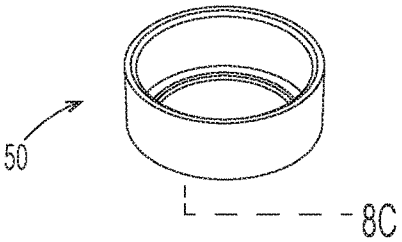
FIG. 8B is a perspective view of the reinforcing sleeve of FIG. 8A.

Referring to FIGS. 8A-8C, only the lower portion of a housing 30, may be reinforced with a reinforcing sleeve 50. Such a reinforcing sleeve 50 may be inserted onto the housing 30 from below, i.e. in the longitudinally upward direction. This arrangement provides the benefit that the sleeve 50 can be used to selectively reinforce only a lower collar 33L, if included, and ultimately the hole 32.

One of skill will understand that the invention is not limited to embodiments having a single reinforcing sleeve 50. A first sleeve 50 may be used to reinforce an inner collar 33. A second sleeve 50 may be sued to reinforce an outer collar 34. Either such sleeve 50 may be fitted radially internally to and/or radially external to the inner collar 33 and outer collar 34. Yet another sleeve 50 may be fitted to the lower collar 33L. Again, such sleeve(s) 50 may be fitted radially internally to and/or radially external to the lower collar 33L in any combination with the aforementioned sleeves 50.

Figure 9:
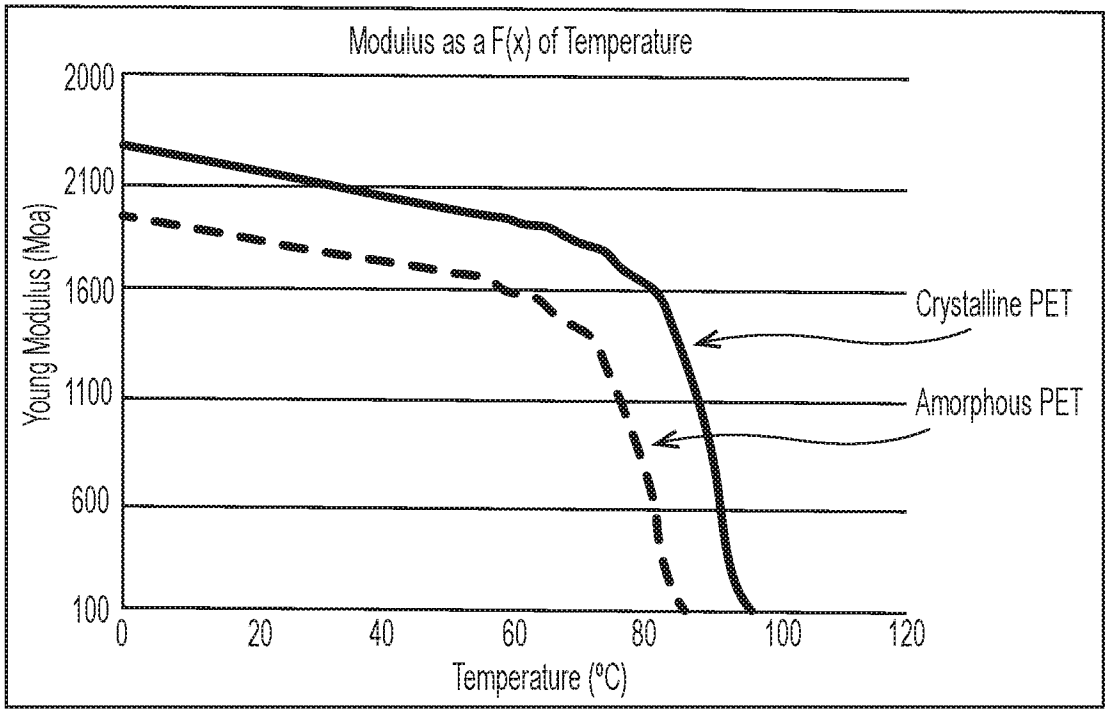
FIG. 9 is a graphical representation of the Young's modulus response to temperature increases for PET.

Referring to FIG. 9, if the housing 30 is made of PET, crystalizing provides the benefit of increasing the Tg from about 70° C. for amorphous PET, particularly about 75° C. for amorphous PET, to about 80° C. for crystallized PET. Unexpectedly, this 5 to 10° C. increase in Tg corresponds to the temperature range which may be encountered during unintended storage and usage of the aerosol dispenser 20. By providing increased Young's modulus throughout this temperature range, propellant 40 leakage can be minimized.

The invention may be made according to the following paragraphs, in any combination or permutation thereof.

A. A valve 28 for use in an aerosol dispenser, said valve 28 comprising:

a housing, said housing having a lower platform 31 for attachment to an outer container 22 of an aerosol dispenser 20, said platform 31 having a housing hole 32 therethrough, and at least one of an inner collar 33 projecting upwardly from said platform 31 or a lower collar 33L projecting downwardly from said platform 31, a seal 30S circumscribing said housing hole 32 and having a seal hole therethrough, a valve stem 28S slidably disposed in said seal hole, and a reinforcing sleeve 50 in radial contact with said at least one of said inner collar 33 and said lower collar 33L, said reinforcing sleeve 50 being selected from the group consisting of crystallized polymeric material, metal and carbon fiber.

B. A valve 28 according to paragraph A wherein said at least one collar is a lower collar 33L and said sleeve 50 is fitted radially external to said lower collar 33L.

C. A valve 28 according to paragraphs A and B wherein said at least one collar is a lower collar 33L and said sleeve 50 is a crystallized PET sleeve 50 friction fitted to said lower collar 33L.

D. A valve 28 according to paragraph A, wherein said at least one collar is an inner collar 33 and said sleeve 50 is fitted radially external to said inner collar 33.

E. A valve 28 according to paragraphs A and D wherein said at least one collar is an inner collar 33 and said sleeve 50 comprises carbon fiber fitted radially external to said inner collar 33.

F. A valve 28 according to paragraphs A, B, C, D and E wherein said platform 31 is crystallized G. A housing 30 for a valve 28 usable in an aerosol dispenser 20, said housing 30 comprising:

a lower platform 31, said platform 31 having a housing hole 32 therethrough, and at least one collar projecting upwardly from said platform 31, at least a portion of said platform 31 being crystallized.

H. A housing 30 according to paragraph G wherein said at least one collar comprises an inner collar 33 disposed radially outward of said housing hole 32 and an outer collar 34 disposed radially outward of said inner collar 33.

I. A housing 30 according to paragraphs G and H wherein said at least one collar comprises an inner collar 33 and an outer collar 34, each of said inner collar 33 and said outer collar 34 circumscribing said housing hole 32.

J. A housing 30 according to paragraphs G, H and I wherein said at least one collar comprises an inner collar 33 and an outer collar 34, said entire platform 31 being crystalized and said inner collar 33 and said outer collar 34 being amorphous.

K. A housing 30 according to paragraphs G, H, I and J wherein said platform 31 comprises a downwardly sloped pocket 31P circumscribing said housing hole 32 and a flange 31F disposed radially outwardly of said sloped pocket 31P, wherein said entire platform 31 is crystallized L. A housing 30 according to paragraphs G, H, I and J wherein said platform 31 comprises a downwardly sloped pocket 31P circumscribing said housing hole 32 and a flange 31F disposed radially outwardly of said sloped pocket 31P, wherein said pocket 31P is crystallized and said flange 31F is amorphous.

M. A housing 30 according to paragraphs G, H, I, J, K and L wherein said at least one collar comprises an inner collar 33 and an outer collar 34, at least one of said inner collar 33 and said outer collar 34 having circumferentially spaced reinforcing ribs 35 joined thereto.

N. A housing 30 according to paragraphs G, H, I, J, K, L and M wherein said entire platform 31 is crystallized and further comprising a seal 30S concentrically disposed within said housing hole 32.

O. An aerosol dispenser 20 comprising:

an outer container 22 having a closed end bottom and a neck 24 with an opening therethrough, a product delivery device disposed in said outer container 22, a propellant disposed within said outer container 22 at a pressure greater than atmospheric pressure, a normally closed valve 28 sealingly disposed in said neck for selectively dispensing a product from said aerosol dispenser 20, said normally closed valve 28 comprising a housing 30 having a lower platform 31 joined to said neck 24, said platform 31 having a housing hole 32 therethrough, at least a portion of said platform 31 being crystallized.

P. An aerosol dispenser 20 according to paragraph O wherein said entire platform 31 is crystallized to at least 20%.

Q. An aerosol dispenser 20 according to paragraphs O and P wherein said entire platform 31 is crystallized to at least 30%.

R. An aerosol dispenser 20 according to paragraphs O, P and Q wherein said entire platform 31 is crystallized to a platform 31 percentage and said neck is crystallized to a neck percentage, said platform 31 percentage and said neck percentage being substantially equal.

S. An aerosol dispenser 20 according to paragraphs O, P, Q and R wherein said platform 31 comprises a downwardly sloped pocket 31P circumscribing said housing hole 32 and a flange 31F disposed radially outwardly of said sloped pocket 31P, said flange 31F being crystallized to a flange 31F percentage and said neck is crystallized to a neck percentage, said flange 31F percentage and said neck percentage being substantially equal.

T. An aerosol dispenser 20 according to paragraphs O, P, Q, R and S wherein said entire platform 31 is crystallized to at least 20% and further comprising a product in fluid communication with said product delivery device and an actuator operably connected to said valve 28.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A valve for use in an aerosol dispenser, the valve comprising:

a housing, the housing having a platform for attachment to an outer container of an aerosol dispenser, the platform having a housing hole therethrough, and an outer collar projecting upwardly from the platform, an inner collar projecting upwardly from the platform, and a lower collar projecting downwardly from the platform, wherein the lower collar projecting downwardly is positioned between the outer collar and the inner collar;

a seal circumscribing the housing hole and having a seal hole therethrough;

a valve stem slidably disposed in the seal hole; and a reinforcing sleeve in radial contact with the inner collar or the lower collar, the reinforcing sleeve being selected from the group consisting of crystallized polymeric material, metal and carbon fiber.

2. The valve according to claim 1 wherein the sleeve is fitted radially external to the lower collar.

3. The valve according to claim 1 wherein the sleeve is a crystallized PET sleeve friction fitted to the lower collar.

4. The valve according to claim 1 wherein the sleeve is fitted radially external to the inner collar.

5. The valve according to claim 1 wherein the sleeve comprises carbon fiber fitted radially external to the inner collar.

6. The valve according to claim 1 wherein the platform is crystallized.

7. A housing for a valve usable in an aerosol dispenser, the housing comprising:

a platform, the platform having a housing hole therethrough;

an inner collar projecting upwardly from the platform; and an outer collar projecting upwardly from the platform, wherein the platform comprises a downwardly sloped pocket circumscribing the housing hole and one or more energy concentrators configured for attachment during welding, wherein the outer collar has circumferentially spaced reinforcing ribs joined thereto, and wherein at least a portion of the platform being crystallized.

8. The housing according to claim 7 wherein the inner collar is disposed radially outward of the housing hole and the outer collar disposed radially outward of the inner collar.

9. The housing according to claim 7 wherein each of the inner collar and the outer collar circumscribing the housing hole.

10. The housing according to claim 7 the entire platform being crystalized and the inner collar and the outer collar being amorphous.

11. The housing according to claim 7 comprising a flange, wherein the flange extends radially outwardly of the sloped pocket, and wherein the entire platform is crystallized.

12. The housing according to claim 7, comprising a flange disposed outboard of the pocket, wherein the pocket is crystallized and the flange is amorphous.

13. The housing according to claim 7, wherein the inner collar having circumferentially spaced reinforcing ribs joined thereto.

14. The housing according to claim 7 wherein the entire platform is crystallized and further comprising a seal concentrically disposed within the housing hole.

15. An aerosol dispenser comprising:

an outer container having a closed end bottom and a neck with an opening therethrough;

a product delivery device disposed in the outer container, a propellant disposed within the outer container at a pressure greater than atmospheric pressure;

a normally closed valve sealingly disposed in the neck for selectively dispensing a product from the aerosol dispenser, the normally closed valve comprising a housing having a platform joined to the neck, the platform having a housing hole therethrough, at least a portion of the platform being crystallized; and an inner collar projecting upwardly from the platform and a lower collar projecting downwardly from the platform, wherein the platform comprises a downwardly sloped pocket circumscribing the housing hole and a flange disposed outboard of the pocket, wherein the downwardly sloped pocket is positioned between the bottom of the outer container and the inner collar, and wherein the pocket extends below the flange portion of the platform.

16. The aerosol dispenser according to claim 15 wherein the entire platform is crystallized to at least 20%.

17. The aerosol dispenser according to claim 16 wherein the entire platform is crystallized to at least 30%.

18. The aerosol dispenser according to claim 15 wherein the entire platform is crystallized to a platform percentage and the neck is crystallized to a neck percentage, the platform percentage and the neck percentage being substantially equal.

19. The aerosol dispenser according to claim 15 wherein the flange being crystallized to a flange percentage and the neck is crystallized to a neck percentage, the flange percentage and the neck percentage being substantially equal.

20. The aerosol dispenser according to claim 15 wherein the entire platform is crystallized to at least 20% and further comprising a product in fluid communication with the product delivery device and an actuator operable connected to the valve.

21. The aerosol dispenser according to claim 19 wherein the entire platform 31 is crystallized to at least 20% and further comprising a product in fluid communication with the product delivery device and an actuator operably connected to the valve.

* * * * *